US011193658B1

(12) United States Patent
Yablonicky

(10) Patent No.: US 11,193,658 B1
(45) Date of Patent: Dec. 7, 2021

(54) SYSTEM FOR COUPLING LIGHT STRANDS TO A STRUCTURE USING ELASTIC ELEMENTS

(71) Applicant: Michael Yablonicky, Miami Beach, FL (US)

(72) Inventor: Michael Yablonicky, Miami Beach, FL (US)

( * ) Notice: Subject to any disclaimer, the term of this patent is extended or adjusted under 35 U.S.C. 154(b) by 0 days.

(21) Appl. No.: 17/087,885

(22) Filed: Nov. 3, 2020

(51) Int. Cl.

| | |
|---|---|
| ***F21V 21/08*** | (2006.01) |
| ***F21S 4/10*** | (2016.01) |
| ***F21V 17/10*** | (2006.01) |
| ***F21V 23/06*** | (2006.01) |
| ***F21Y 115/10*** | (2016.01) |

(52) U.S. Cl.
CPC ..... *F21V 21/0816* (2013.01); *F21S 4/10* (2016.01); *F21V 17/10* (2013.01); *F21V 23/06* (2013.01); *F21Y 2115/10* (2016.08)

(58) Field of Classification Search
CPC ..... F21V 21/0816; F21V 23/06; F21V 17/10; F21V 21/08; F21S 4/10; F21S 4/00; F21S 4/26; F21Y 2115/10; F21W 2131/00
See application file for complete search history.

(56) References Cited

U.S. PATENT DOCUMENTS

| | | | | |
|---|---|---|---|---|
| 4,335,422 | A * | 6/1982 | Van Ess | F21S 4/10 362/249.01 |
| 5,531,411 | A | 7/1996 | Adams | |
| 5,957,564 | A * | 9/1999 | Bruce | F21S 4/10 362/84 |
| 6,056,422 | A | 5/2000 | Huang | |
| 6,203,171 | B1 * | 3/2001 | Sherman, Jr. | A47G 33/06 362/121 |
| 10,107,462 | B1 * | 10/2018 | Loomis | F21S 4/22 |
| 10,989,378 | B2 * | 4/2021 | Chien | F21S 10/007 |
| 2007/0008724 | A1 * | 1/2007 | Raska | F21S 4/20 362/249.16 |
| 2008/0185785 | A1 * | 8/2008 | Sullivan | A63B 43/06 273/317 |
| 2010/0195332 | A1 * | 8/2010 | Wasem | F21V 25/10 362/249.16 |
| 2011/0164409 | A1 * | 7/2011 | Smith | F21S 4/10 362/145 |
| 2020/0208794 | A1 * | 7/2020 | Stange | F21V 21/0816 |

* cited by examiner

*Primary Examiner* — Peggy A Neils
(74) *Attorney, Agent, or Firm* — Sanchelima & Associates, P.A.; Christian Sanchelima; Jesus Sanchelima

(57) ABSTRACT

An illuminated decoration system includes light strings having elastic elements for coupling the lights to structures. The system includes a light strand assembly and an elastic assembly, the elastic assembly may be integral to the light strand or attached externally through clipping members. The light strand assembly includes illuminated elements which may be separated by a predetermined amount of space along the strand. The elastic assembly includes an elastic element which is attached, either integrally or externally to the light strand. The elastic elements allow for the system to store elastic energy when being mounted onto a structure. The stored elastic energy allows the light strand to stay mounted onto the structure without the need for staples, nails, hook and loop fasteners, glue, or silicone.

17 Claims, 8 Drawing Sheets

SYSTEM FOR COUPLING LIGHT STRANDS TO A STRUCTURE USING ELASTIC ELEMENTS

BACKGROUND OF THE INVENTION

1. Field of the Invention

The present invention relates to a system for mounting illuminated decorations and, more particularly, to a system for mounting illuminated decorations that includes light strings having elastic elements for attaching the lights to structures.

2. Description of the Related Art

Several designs for illuminated decorations have been designed in the past. None of them, however, include an illuminated decoration system that includes light strings having elastic elements for coupling the lights to structures. The system includes a light strand assembly and an elastic assembly which may be integral or added externally to the light strand. The light strand assembly includes illuminated elements which may be separated by a predetermined amount of space along the strand. The elastic assembly includes at least one elastic element which is attached or externally added to the light strand. In one embodiment, due elastic element is attached to every other light on the light strand. The elastic elements allow for the system to store elastic energy when being mounted onto a structure. This allows the light strand to stay coupled onto the structure without the need for staples or any other securing methods such as nails, hook and loop fasteners, glue, or silicone.

It is known that light strands are often mounted to structures using staples. However, the method of using staples have issues regarding electrical safety, installation troubles, and expensive costs in purchasing the staple guns and staples needed for mounting the light strands. Additionally, the use of staples causes damage to the lights when being mounted or removed due to the delicate structure of the light strand. Therefore, there is a need for an illuminated decoration system that eliminates the need for staples and provides an effortless mounting means using elastic elements. Other securing methods for the lights include glue, hook and loop fasteners, nails, and silicon which are inferior to the present invention.

Applicant believes that a related reference corresponds to U.S. Pat. No. 6,056,422 issued for a Christmas light with an elastic attachment. Applicant believes that another related reference corresponds to U.S. Pat. No. 5,531,411 issued for a mounting clip for decorative lights. However, the cited references differ from the present invention because they fail to disclose an illuminated decoration comprising light strings having elastic elements for attaching the lights to structures such as trees and palm trees.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide an illuminated decoration system which eliminates the need for using staples to couple light strands to structures such as columns and trees.

It is another object of this invention to provide an illuminated decoration system which eliminates the additional costs associated with purchasing staple guns and staples when mounting light strands on structures.

It is still another object of the present invention to provide an illuminated decoration system which eliminates the excess time associated with mounting light strands using staple guns.

It is still another object of the present invention to provide an illuminated decoration system which improves effectiveness and allows mounted light strands to withstand harsh weather conditions such as wind and rain.

It is still another object of the present invention to provide an illuminated decoration system which eliminates the electrical safety hazard associated with using staples to mount light strands.

It is still another object of the present invention to provide an illuminated decoration system that reduces the damage to structures and light strands.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
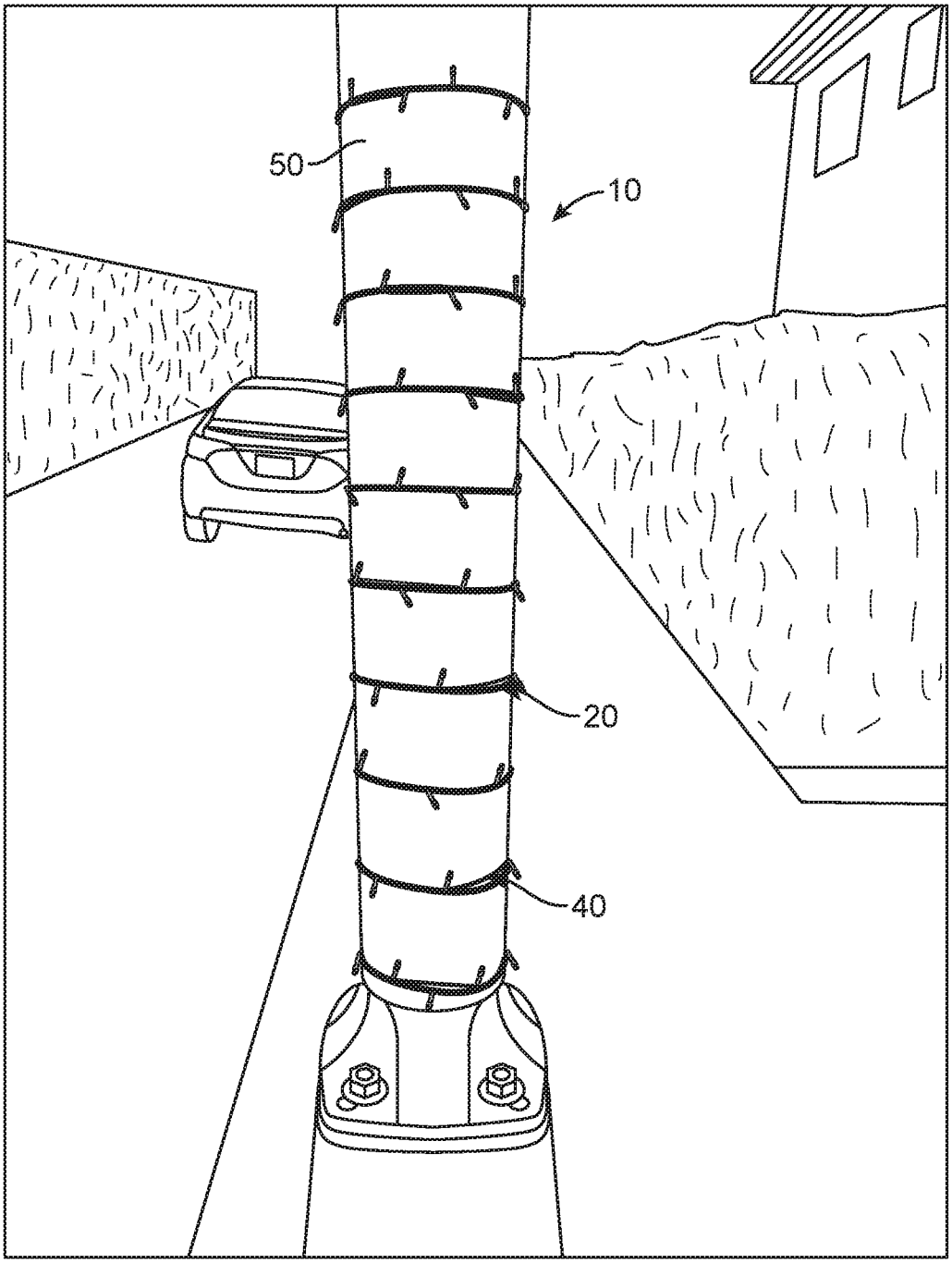
FIG. 1 represents an isometric view of a structure 50 having illuminated decoration system 10 mounted thereon in accordance to an embodiment of the present invention.

Referring now to the drawings, where the present invention is generally referred to with numeral 10, it can be observed an illuminated decoration system 10 that basically includes a light strand assembly 20 and an elastic assembly 40.

Light strand assembly 20 includes a strand 22 having a plurality of illuminated elements 24. An accurate depiction of light strand assembly 20 may be observed in FIGS. 9 and 10 in accordance to an embodiment of the present invention. It can be observed that strand 22 includes two opposing distal ends. One the distal ends comprises an electrical socket plug which is inserted into an electrical power source. It should be understood that the electrical socket plug that is used is to correspond with the socket of the electrical power source which may vary in different situations. It is understood that different electrical plugs are used in different countries to receive electrical power. The other opposing distal end of the strand 22 includes a connector. The connector receives a corresponding electrical socket plug which may be used to power and additional strand 22 of lights that is connected thereon. The connection will provide the additional strand or any other electrical periphery with electrical power when plugged therein. In one embodiment, strand 22 is made of a durable braided plastic material. However, it should be understood that other materials may be appreciated for the implementation of the strand 22. Further, strand 22 comprises and electrical conducting wire which runs therethrough and provides electrical power to the corresponding plurality of illuminated elements 24 located along the strand. In another embodiment, strand 22 is a braided strand which incorporates an elastic strand element that is woven into the braided section of the strand.

Figure 2:
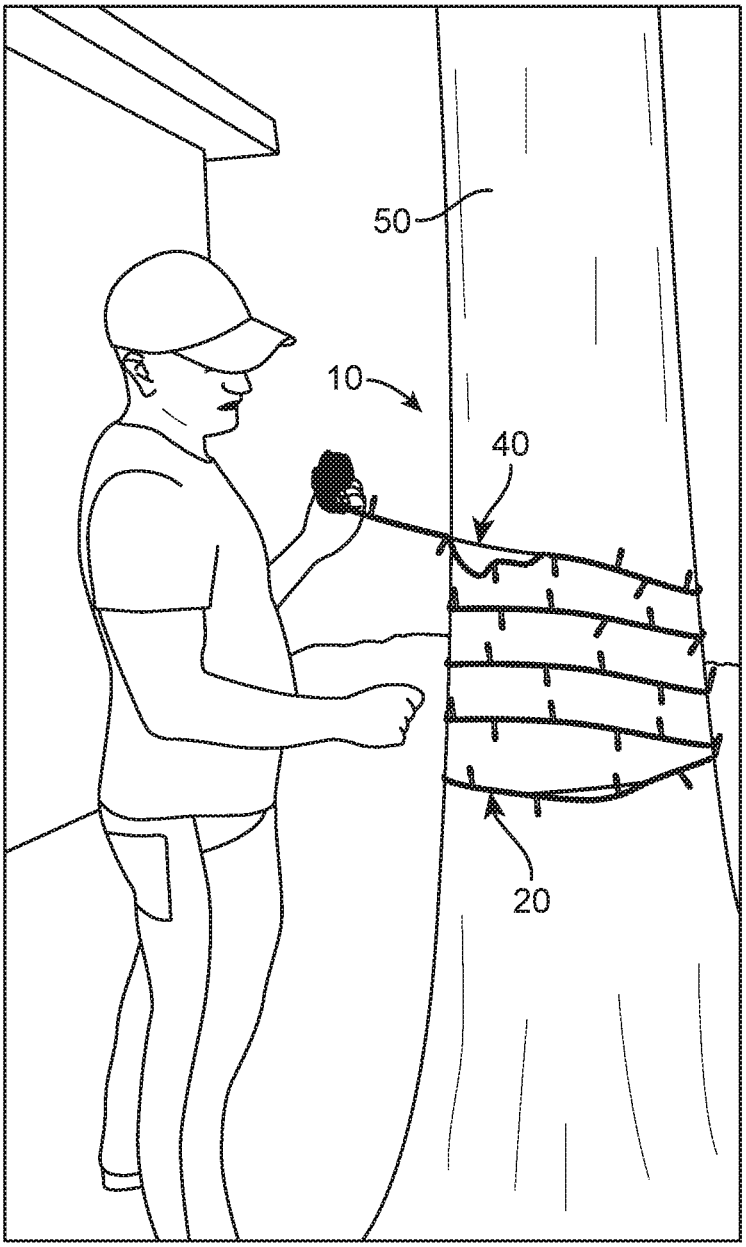
FIG. 2 shows an operational isometric view of illuminated decoration system 10 depicting a user mounting the system onto a structure 50. In this operational view, the elastic element is in a resting position.
Figure 3:
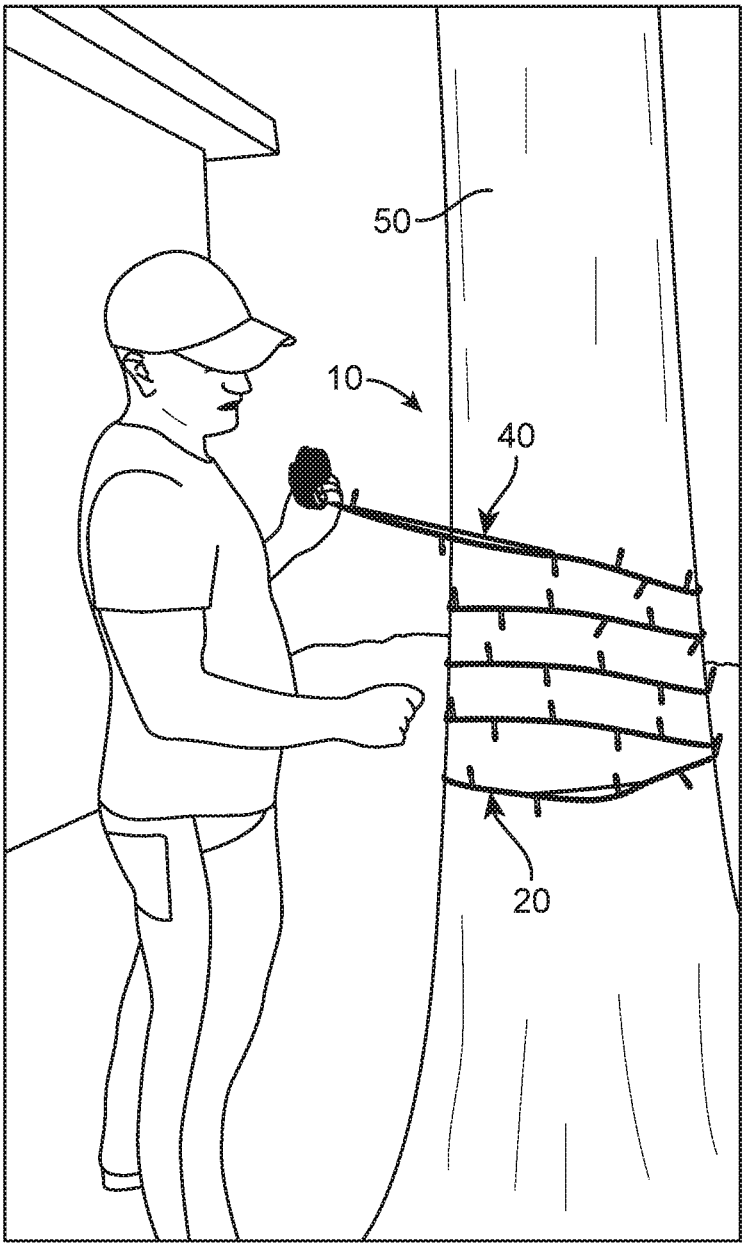
FIG. 3 illustrates an operational isometric view of illuminated decoration system 10 depicting a user mounting the system onto a structure 50. In this operational view, the elastic element is in a displacement position storing elastic energy.

In the present embodiment, strand 22 is to be wrapped around a structure 50 as observed in FIGS. 1-3 of the provided drawings. In one embodiment, structure 50 is provided as a structure. The present invention aims to eliminate the need for staples that is currently used when mounting light strand assembly 20 to a structure. However, it can be appreciated that structure 50 is not limited to only being a structure. FIG. 1 depicts a structure being a street post. FIGS. 2 and 3 depict a structure being a tree. Other embodiments may feature any variety of structure which may be implemented in the system. In various embodiments, the length of strand 22 may vary and depends on the dimensions of structure 50. In one embodiment, strand 22 is provided as being a strand of 33 feet with 100 illuminated elements and having a spacing of 4 inches between the plurality of illuminated elements 24 provided along the strand 22. It should be understood that any variation of strand length and illuminated elements may be used.

Illuminated elements 24 may be defined as any component which may be illuminated upon receipt of electrical power. In one embodiment, illuminated elements 24 is provided as being Light Emitting Diodes (LEDs) which can have a variety of colors or a uniform color structure. In another embodiment, illuminated elements 24 are implemented as standard incandescent light bulbs. Other light bulbs may be used. In yet another embodiment, illuminated elements 24 are provided as being WiFi capable illuminated elements 24 which allow for a user to configure the color or brightness of the lights over a WiFi connection. In one implementation this WiFi connection may be provided over a mobile device such as a phone or a laptop or a tablet.

Figure 4:
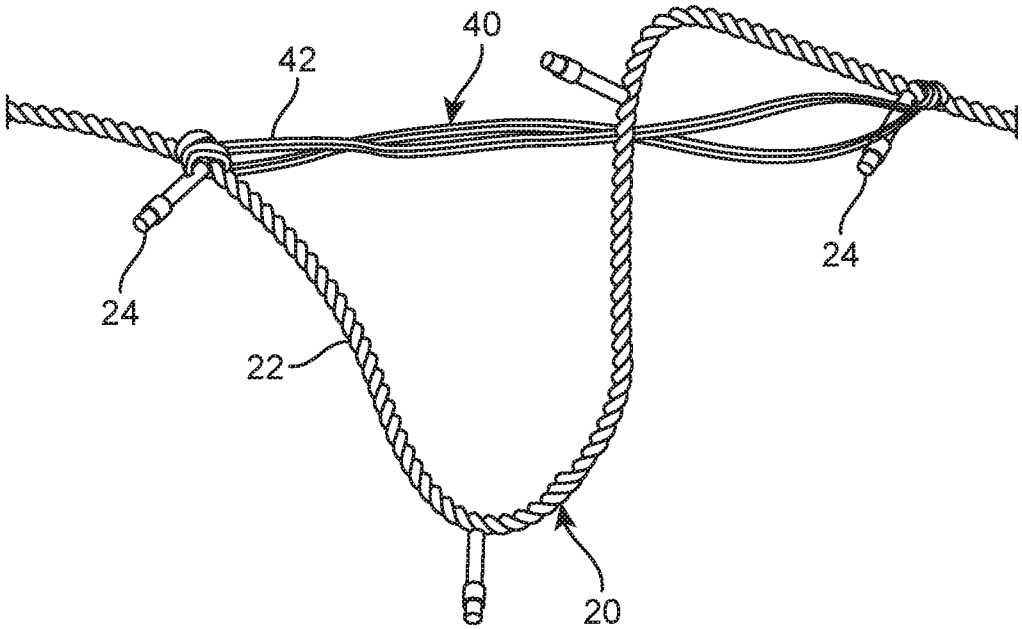
FIG. 4 is a representation of an enlarged isometric view of light strand assembly 20 having elastic assembly 40 attached thereon in a resting position in accordance to an embodiment of the present invention.
Figure 5:
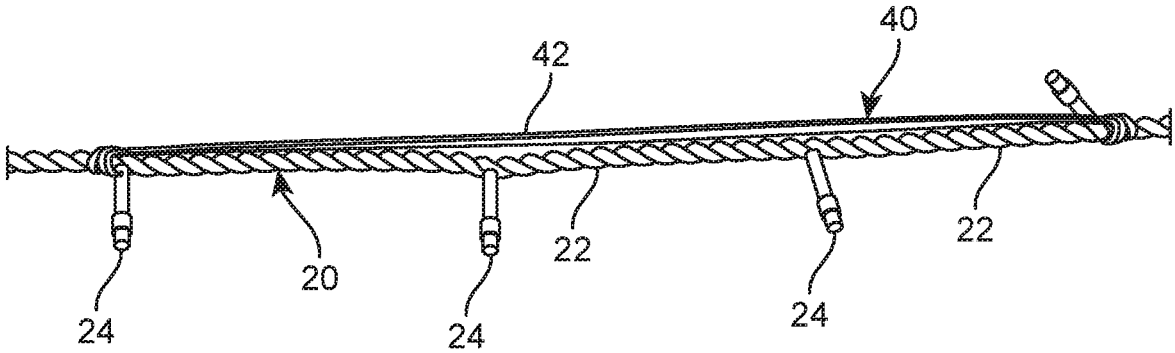
FIG. 5 shows an enlarged isometric view of light strand assembly 20 having elastic assembly 40 attached thereon in a displacement position in accordance to an embodiment of the present invention.

Elastic assembly 40 includes an elastic element 42 which may be properly observed in FIGS. 4 and 5 of the drawings. In one embodiment, elastic element 42 is provided as an elastomer material. In one example, elastic element 42 is a diene elastomer selected from a group consisting essentially of polyisoprene, polybutadiene, or polychloroprene. In another example, elastic element 42 is a non-diene elastomer selected form a group consisting essentially of butyl rubber (polyisobutylene), polysiloxanes (silicone rubber), or polyurethane (spandex). In yet another example, elastic element 42 is a thermoplastic elastomer. In yet another example, elastic element 42 may be made of ethylene propylene diene monomer (EPDM), which is a type of synthetic rubber. It should be appreciated that other types of elastics may be implemented into the disclosed system. In one embodiment, elastic element 42 includes a relaxed position having a length of at least 7 inches. Further, when elastic element 42 is stretched into a displacement position, the elastic element may provide a stretched length of at least 12 inches. One other example may include the elastic element having a relaxed position of ½ inch and a displacement position of 1 inch. In yet another example, the elastic element includes a relaxed position of 20 feet and a displacement position of 30 feet. Other examples may feature the elastic element having a maximum displacement position of up to 50 feet.

As observed in FIGS. 4 and 5, elastic element 42 may be provided as a linear element that is tied directly onto the strand 22. Any form of knot can be formed to effectively couple the elastic element 42 to the strand 22. In one embodiment, elastic element 42 is provide as being integrally connected to strand 22. As observed in FIG. 4, elastic element 42 is secured to the strand 22 in a relaxed position along a length of strand 22. In the observed embodiment, elastic element 42 is coupled onto two illuminated elements 24 located on the strand 22. However, elastic element 42 may be mounted anywhere along the strand. It should be understood that in this relaxed position the displacement of strand 22 between the elastic element 42 should be greater than the total length of the elastic element. When an external pulling force is applied to the strand 22, elastic element 42 is then forced into a displacement position as observed in FIG. 5. In this displacement position, the system is effectively storing elastic potential energy which will be utilized to couple the light strand assembly 20 to structure 50. In this displacement position, the elastic element 42 is pulled to a length that corresponds to the displacement of strand 22 between in the elastic element 42.

Figure 6:
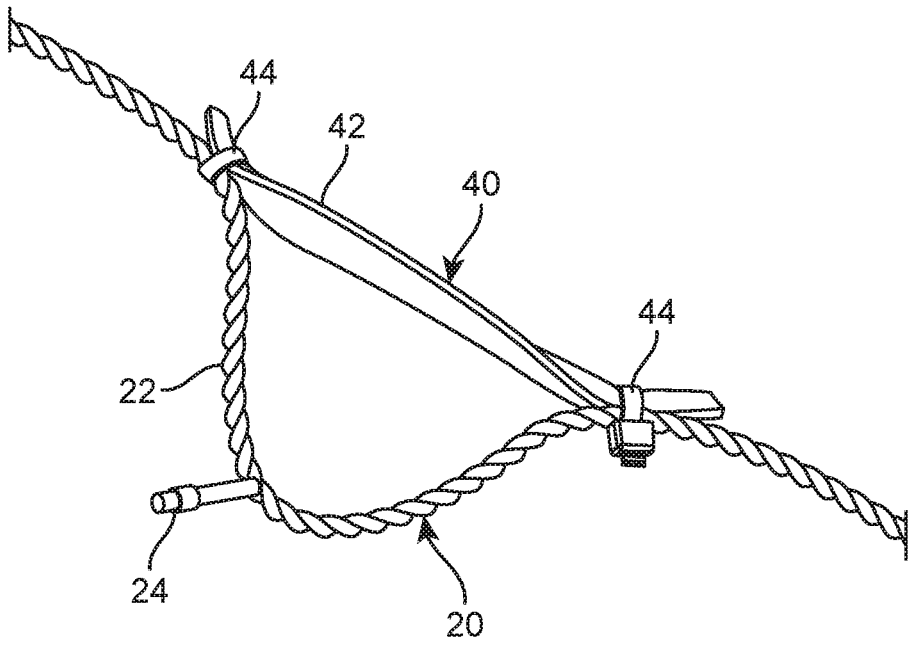
FIG. 6 illustrates an enlarged isometric view of light strand assembly 20 having elastic assembly 40 in a resting position attached using coupling members in accordance to another embodiment of the present invention.
Figure 7:
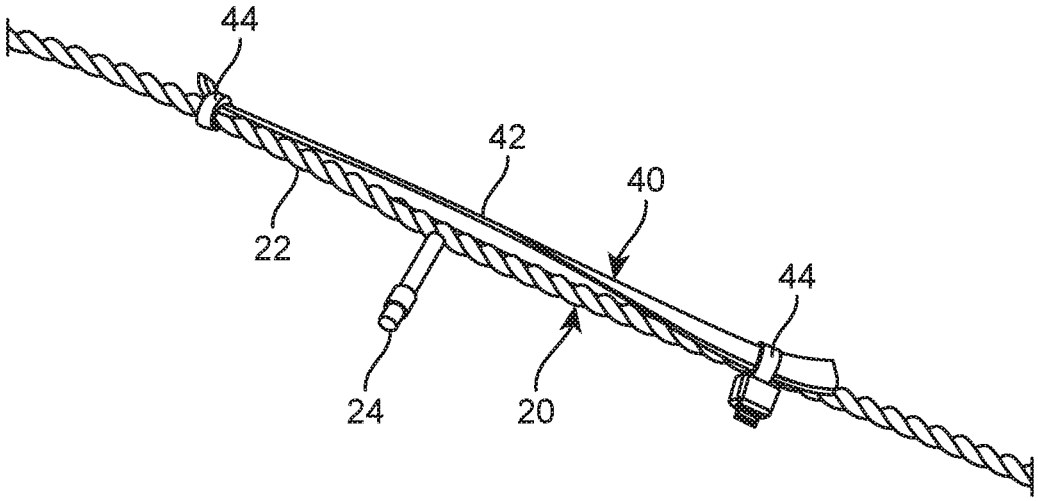
FIG. 7 represents an enlarged isometric view of light strand assembly 20 having elastic assembly 40 in a displacement position attached using coupling members in accordance to an embodiment of the present invention.
Figure 8:
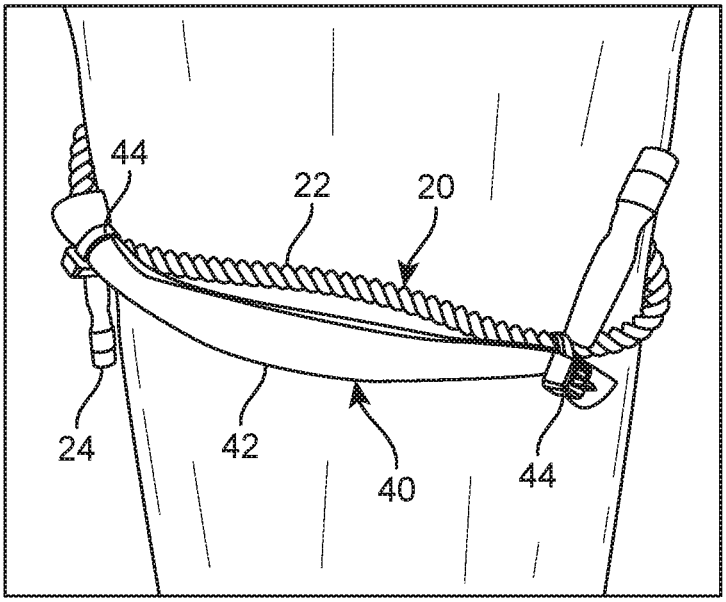
FIG. 8 shows and enlarged isometric view of a structure 50 having illuminated decoration system 10 mounted thereon in accordance to an embodiment of the present invention.

FIGS. 6 and 7 depict another embodiment of elastic assembly 40 which features at least two coupling members 44. As observed, elastic element 42 maybe coupled to strand 22 using coupling members 44. Coupling members 44 are provided along the opposing distal ends of the elastic element 42 and abuttingly receive the strand 22 thereon. In one embodiment, coupling members 44 are provided as zip tie members which are wrapped around the elastic element 42 and the strand 22. Other embodiments may feature other forms of coupling members such as snap buttons, adhesives strips, snap locks, button locks and the like.

Figure 9:
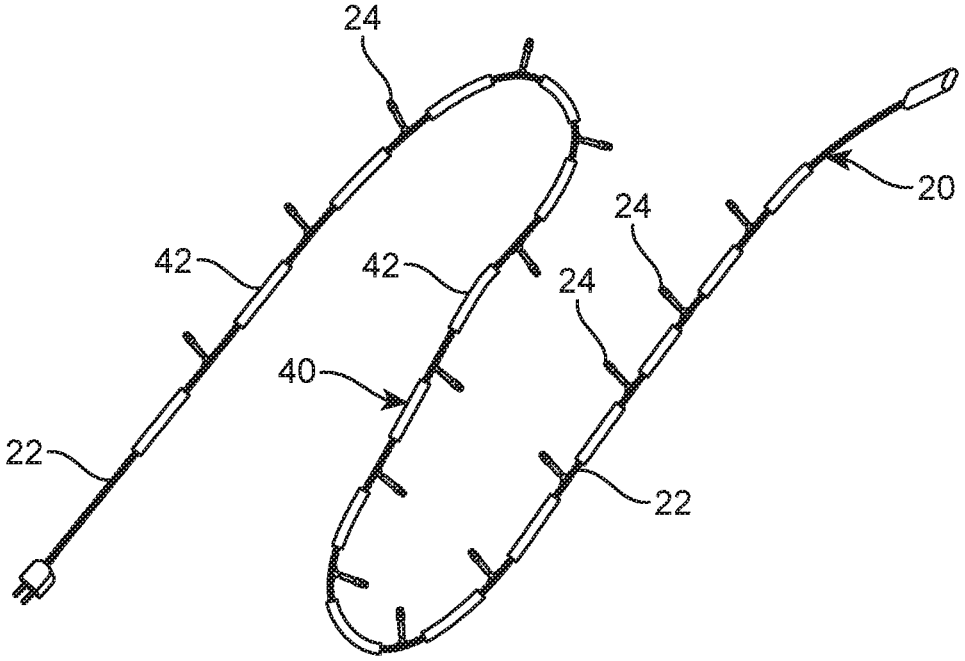
FIG. 9 illustrates a front view of light strand assembly 20 having elastic assembly 40 mounted in an alternating pattern along the light strand.
Figure 10:
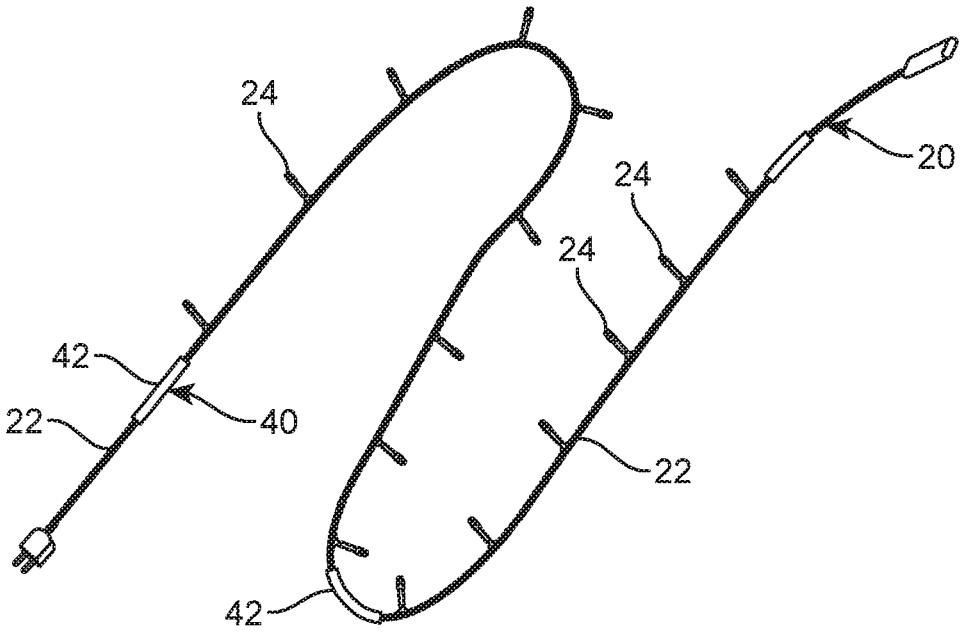
FIG. 10 is a representation of a front view of light strand assembly 20 having elastic assembly 40 divided onto three sections along the light strand.

As observed in FIGS. 9 and 10, elastic elements 42 may be positioned along various locations of the strand 22. In the embodiment depicted in FIG. 9, elastic elements are positioned in an alternating pattern along strand 22. This alternating pattern is defined by an elastic element 42 being placed between two illuminated elements 24 along the length of the strand 22. In another embodiment, as observed in FIG. 10, elastic element 42 is provided along three sections of the strand 22. These sections are defined as a two opposing end sections and a middle section. The present system may be adjusted to include any number of elastic elements 42 along the strand 22.

Figure 11:
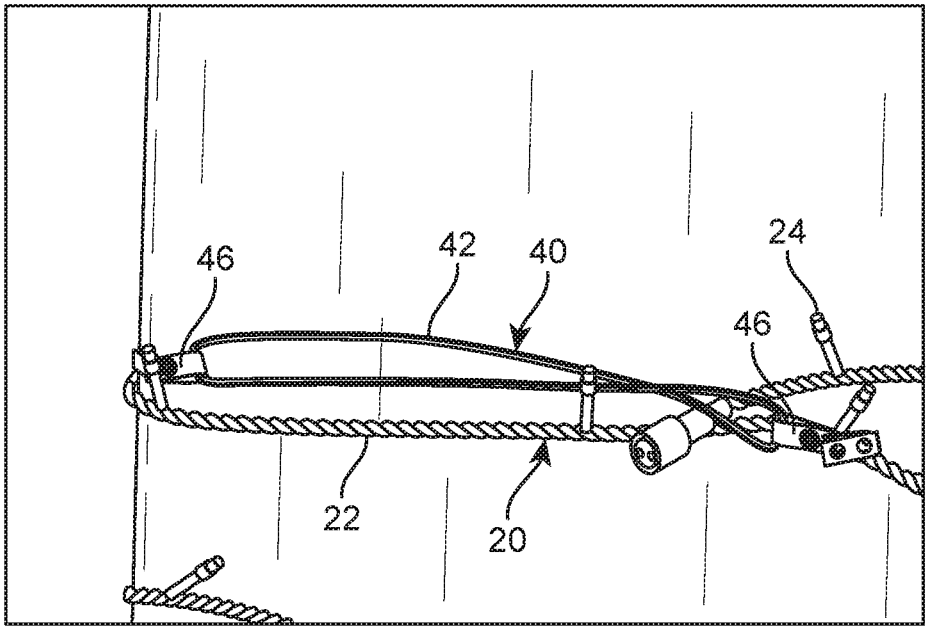
FIG. 11 shows an enlarged isometric view of illuminated decoration system 10 mounted to a structure 50 wherein the elastic assembly 40 utilizes an attachment member to reinforce the light strand and keep it from falling down.
Figure 12:
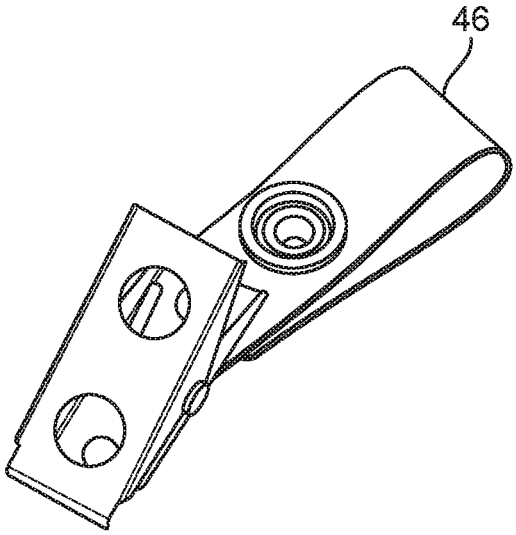
FIG. 12 is an illustration of an isometric view of attachment member 44 in accordance to an embodiment of the present invention.

FIGS. 11 and 12 depict yet another embodiment of the elastic assembly 40 which includes attachment members 46. In the present embodiment, attachment members 46 are used to couple the elastic element 42 onto the light strand 22. It is observed in FIG. 12 that attachment member 46 includes a looped portion and a clip portion. In the present embodiment, the clipped portion is attached to the strand 22 and the looped portion is received by the elastic member 42. In the present embodiment, attachment members 46 are used to incorporate elastic element 22 of existing systems of light strands. It should be understood the present system may be manufactured having elastic elements 42 either looped or attached onto strand 22 using coupling members 44. Alternatively, the elastic elements 42 may be provided as separate to the strand 22 and may be integrated into the system externally using attachment members 46. The present system may include at least one elastic element 42 having attachment members 46. One embodiment may feature a strand 22 having two distal ends with each end having an elastic element 42 with attachment members 46 mounted thereon. As observed in FIG. 11, when mounted onto structure 50, the elastic element 42 with attachment members 46 are used to anchor the top of the strand 22 when coupled to the structure 50. Additionally, the elastic element 42 with attachment members 46 is used to anchor the bottom of the strand 22 when coupled to the structure 50. It should be appreciated that any number of elastic elements 42 with attachment members 46 may be implemented into the present system.

Now having described the elastic assembly 40, the light strand assembly 20 is mounted to a structure as observed in FIGS. 1-3. Light strands 20 are often wrapped around structures 50 for decoration purposes. When coupling light strands 20 around structure 50, there exists and amount of slack or displacement that causes the light strand 20 to become lose and fall of the structure 50. To resolve this issue, the current standard in the art is to use a staple gun to couple the light strands 20 to the structure 50. As described in the summary of the invention, this method has its issues with cost and safety. To resolve, the issue of slack and displacement that exists when wrapping the light strands 20, elastic assembly 40 is implemented to the system. Observed in FIG. 2 is a user wrapping light strands 20 to a structure 50. In FIG. 2, the system includes an elastic depicted in the resting position. As a user continues to wrap light strand 20 around structure 50, elastic element 42 is positioned into a displacement position as observed in FIG. 3. The stretched configuration of the elastic element 42 makes up for the slack that causes the light strand 20 to fall down. As a result, the light strand 20 is remains effectively coupled to the structure 50 and the need for staples is eliminated. The present system is more cost efficient, safer, and time efficient than the alternative stapler system.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An illuminated decoration system, comprising:

a. a light string assembly including a strand having a plurality of illuminated elements, said strand having a first end and a second end; and b. an elastic assembly including at least one elastic element mounted along said strand, wherein each of said elastic elements includes first and second opposing distal ends each being coupled to said strand, each of said elastic elements having a relaxed position, and each of said elastic elements having a displacement position when said light string assembly is being coupled to a structure, wherein said elastic element is in a constant expanded and stretched state charged with elastic potential energy when coupled to the structure, wherein the elastic elements are constantly contracting the structure when coupled thereon, an anchor disposed at each of the first end of the strand and the second end of the strand, wherein each of said anchor includes an elastic member with an attachment member secured to each of opposing side ends of the elastic member, wherein each of the attachment members includes a looped portion and a clipping portion, wherein the looped portion is coupled to the elastic member, wherein the clipping portion is clipped onto the strand to adjust the strand along the structure, wherein a topmost distal end of the strand is anchored to the anchor of the first end, wherein a bottommost distal end of the strand is anchored to the anchor of the second end.

2. The illuminated decoration system of claim 1 wherein said strand includes first and second opposing side ends, said first side end including an electrical plug, said second side end including a plug receiver.

3. The illuminated decoration system of claim 1 wherein said plurality of illuminated elements are light emitting diodes.

4. The illuminated decoration system of claim 1 wherein said plurality of illuminated elements are incandescent bulbs.

5. The illuminated decoration system of claim 1 wherein said plurality of illuminated elements are in communication with a mobile device over a WiFi network.

6. The illuminated decoration system of claim 1 wherein said strand is a braided strand.

7. The illuminated decoration system of claim 1 wherein said illuminated elements are spaced apart along said strand.

8. The illuminated decoration system of claim 1 wherein said first and second opposing distal ends of each of said elastic elements includes coupling members.

9. The illuminated decoration system of claim 8 wherein said coupling members are zip ties.

10. The illuminated decoration system of claim 1 wherein each of said elastic element is made of an elastomer material.

11. The illuminated decoration system of claim 10 wherein said elastomer material is a diene elastomer selected from a group consisting essentially of polyisoprene, polybutadiene, polychloroprene, or ethylene propylene diene monomer (EPDM).

12. The illuminated decoration system of claim 10 wherein said elastomer material is a non-diene elastomer selected form a group consisting essentially of butyl rubber (polyisobutylene), polysiloxanes (silicone rubber), or polyurethane (spandex).

13. The illuminated decoration system of claim 10 wherein said elastomer material is a thermoplastic elastomer.

14. The illuminated decoration system of claim 1 wherein each of said elastic elements are abutting with said strand when in the displacement position.

15. The illuminated decoration system of claim 1 wherein a strand displacement length between said first and second opposing distal ends of each of said elastic elements is greater than a length of said elastic element when in said relaxed position.

16. The illuminated decoration system of claim 1 wherein said structure is a column.

17. An illuminated decoration system, consisting of:

a. a structure;

b. a light string assembly including a strand having a plurality of illuminated elements spaced apart along said strand, wherein said plurality of illuminated elements are light emitting diodes which are in wireless communication with a mobile device over a wireless network, said strand having a first end and a second end; and c. an elastic assembly including a plurality of elastic elements mounted along said strand, wherein each of said elastic elements include first and second opposing distal ends each having coupling members to be abuttingly coupled to said strand, wherein each of said elastic element is made of an elastomer material, is a diene elastomer selected from a group consisting essentially of polyisoprene, polybutadiene, polychloroprene, or ethylene propylene diene monomer (EPDM), wherein said coupling members are zip ties, and each of said elastic elements having a displacement position when said light strand assembly is being coupled to said structure, wherein said elastic elements are positioned in an alternating pattern along said strand, said alternating pattern being defined by each of said elastic elements being placed between two of said illuminated elements, wherein said elastic element is in a constant expanded and stretched state charged with elastic potential energy when coupled to the structure, wherein the elastic elements are constantly contracting the structure when coupled thereon, an anchor disposed at each of the first end of the strand and the second end of the strand, wherein each of said anchor includes an elastic member with an attachment member secured to each of opposing side ends of the elastic member, wherein each of the attachment members includes a looped portion and a clipping portion, wherein the looped portion is coupled to the elastic member, wherein the clipping portion is clipped onto the strand to adjust the strand along the structure, wherein a topmost distal end of the strand is anchored to the anchor of the first end, wherein a bottommost distal end of the strand is anchored to the anchor of the second end.

* * * * *